US007107884B2

(12) United States Patent
Cutler et al.

(10) Patent No.: US 7,107,884 B2
(45) Date of Patent: Sep. 19, 2006

(54) ERGONOMIC ELECTRONIC TORQUE WRENCH

(75) Inventors: Brian Cutler, Rowland Heights, CA (US); David Duvan, Chino, CA (US); Charles Davis, Torrance, CA (US); Zoltan Pavlakovich, San Pedro, CA (US)

(73) Assignee: Snap-on Incorporated, Kenosha, WI (US)

( * ) Notice: Subject to any disclaimer, the term of this patent is extended or adjusted under 35 U.S.C. 154(b) by 0 days.

(21) Appl. No.: 10/952,276

(22) Filed: Sep. 28, 2004

(65) Prior Publication Data

US 2005/0072278 A1 Apr. 7, 2005

Related U.S. Application Data

(60) Provisional application No. 60/508,744, filed on Oct. 3, 2003.

(51) Int. Cl.
*B25B 23/14* (2006.01)
*B25B 23/16* (2006.01)

(52) U.S. Cl. ..... 81/479; 81/177.7

(58) Field of Classification Search ..... 81/467, 81/478, 479, 177.1, 177.7, 177.8; 72/862.23; 73/862.23

See application file for complete search history.

(56) References Cited

U.S. PATENT DOCUMENTS 3,895,517 A 7/1975 Otto
3,970,155 A 7/1976 Otto
D244,829 S 6/1977 Lehoczky et al.
4,073,187 A 2/1978 Avdeef
4,125,016 A 11/1978 Lehoczky et al.
4,397,196 A 8/1983 Lemelson
D286,973 S 12/1986 Grabovac
4,641,538 A 2/1987 Heyraud
4,669,319 A 6/1987 Heyraud
4,864,841 A 9/1989 Heyraud
4,958,541 A 9/1990 Annis et al.
4,982,612 A * 1/1991 Rittmann ..... 73/862.23
5,130,700 A 7/1992 Annis et al.
5,537,877 A 7/1996 Hsu
6,070,506 A 6/2000 Becker
6,276,243 B1 8/2001 Jenkins
D458,817 S 6/2002 Jenkins
6,463,811 B1 10/2002 Putney
2003/0196497 A1 10/2003 Geilenbrugge

FOREIGN PATENT DOCUMENTS

WO WO 3041914 A2 * 5/2005

* cited by examiner

*Primary Examiner*—Hadi Shakeri
(74) *Attorney, Agent, or Firm*—Seyfarth Shaw LLP

(57) ABSTRACT

An electronic torque wrench has a tubular core with elongated apertures therein which respectively removably receive user interface assembly and power assembly modules, the modules being exposed through openings in a surrounding grip sheath. A workpiece-engaging head is coupled to a beam member which may received in a tapered opening in a shim member received in an end of the tube. A sensor on the beam member is connected by wires extending to the user interface assembly, which in turn has a display device producing a bar graph display indicating the proximity of a measured torque value to a preset torque level.

8 Claims, 7 Drawing Sheets

ERGONOMIC ELECTRONIC TORQUE WRENCH

RELATED APPLICATION

This application claims the benefit of the filing date of now abandoned U.S. provisional application No. 60/508,744, filed Oct. 3, 2003.

BACKGROUND

This application relates to wrenching tools and, specifically, to torque-measuring and recording wrenches. The application relates in particular to an improvement of the electronic torque wrench disclosed in co-pending U.S. patent application Ser. No. 10/293,006, entitled "Electronic Torque Wrench", filed Nov. 13, 2002, the disclosure of which is incorporated herein by reference.

While that prior wrench works well, it is of relatively complex construction, utilizing a plurality of battery cells and an electronic module which is not easily accessible and replaceable.

SUMMARY

There is disclosed in this application an improved electronic torque wrench which avoids disadvantages of prior wrenches while affording additional structural and operating advantages.

In an embodiment an electronic torque wrench comprises a housing assembly including an inner generally tubular core having first and second elongated apertures formed therein, a grip sleeve telescopically received over the core and having first and second openings therein respectively communicating with the first and second apertures, a user interface assembly coupled to the core and including torque measuring apparatus and disposed in the first aperture and the first opening, a power assembly coupled to the core and disposed in the second aperture and the second opening and electrically connected to the user interface assembly; a workpiece-engaging head carried by the core and sensing apparatus carried by the housing assembly and connected to the torque measuring apparatus.

In an embodiment, the torque measuring apparatus includes a processor operating under stored program control, and the user interface assembly includes a data input device and display apparatus, the processor program including a routine responsive to the input device for selectively setting or changing a preset torque level, the processor program including a routine for comparing torque values measured by the torque measuring apparatus with the preset torque level and causing the display apparatus to product a bar graph display indicating the proximity of the measured torque value to the preset torque level.

In an embodiment, the workpiece-engaging head is part of a head assembly which includes a mounting portion receivable in the core, the wrench further including shim structure receivable in the core between the mounting portion and the core for firmly mounting the head assembly in place.

In an embodiment, there is also provided a method of assembling an electronic torque wrench comprising A method of assembling an electronic torque wrench comprising providing a tubular core with first and second apertures therein, mounting a user interface assembly module including a torque measuring apparatus in the first aperture, mounting a power assembly module in the second aperture, mounting a workpiece-engaging head assembly including a sensing apparatus in an end of the core, electrically connecting the sensing apparatus to the torque measuring apparatus, and fixedly securing the head assembly in the tubular core.

BRIEF DESCRIPTION OF THE DRAWINGS

For the purpose of facilitating an understanding of the subject matter sought to be protected, there is illustrated in the accompanying drawings an embodiment thereof, from an inspection of which, when considered in connection with the following description, the subject matter sought to be protected, its construction and operation, and many of its advantages should be readily understood and appreciated.

DETAILED DESCRIPTION

Figure 1:
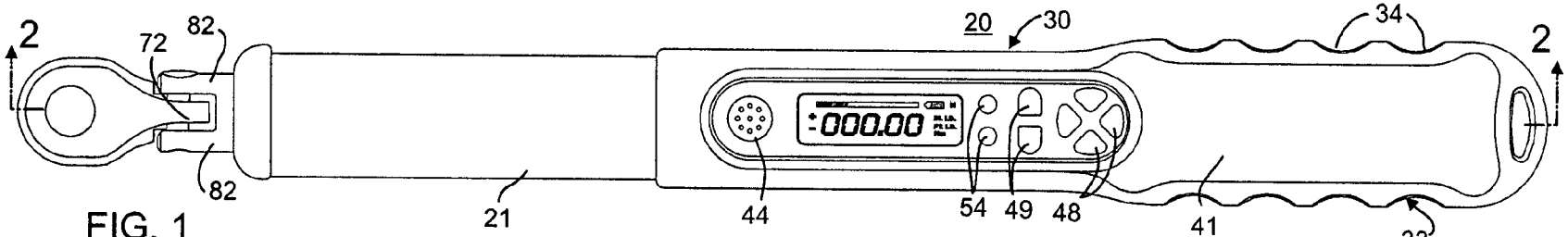
FIG. 1 is a top plan view of an electronic torque wrench.
Figure 2:
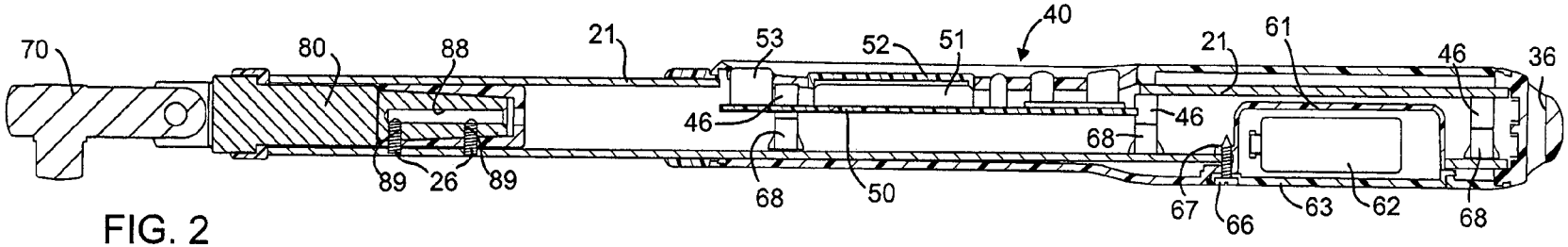
FIG. 2 is a sectional view taken generally along the line 2—2 in FIG. 1.
Figure 3:
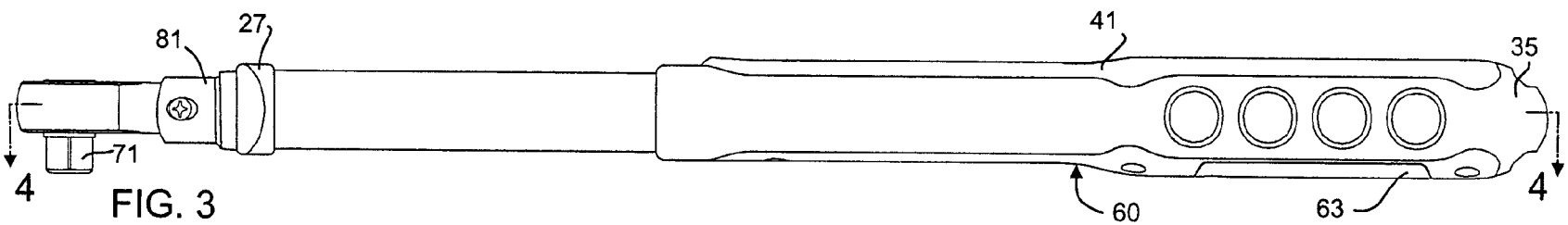
FIG. 3 is a front elevational view of the torque wrench of FIG. 1.

Referring to the drawings, there is illustrated an electronic torque wrench, generally designated by the numeral 20 (FIG. 1) of the bending beam type. The torque wrench 20 has a handle assembly which includes a handle core 21, the rear portion of which is telescopically received within a grip sleeve 30. Referring in particular to FIGS. 6–9, the handle core 21 is an elongated, hollow, tubular body substantially oval in transverse cross-sectional shape, having an elongated, generally rectangular aperture 22 in the top thereof, generally longitudinally centrally thereof, and another generally rectangular aperture 23 formed in the bottom thereof adjacent to the rear end thereof, the aperture 23 extending part way up along the sides of the core. Also formed through the core 21 are two relatively large circular holes 24 adjacent to the forward end of the aperture 22, two pairs of medium-sized circular holes 25, with one pair immediately adjacent to the rear end of the aperture 22 and another pair adjacent to the rear end of the core 21, and a pair of small circular holes 26 (see FIGS. 2 and 4) formed in the bottom of the core 21 adjacent to the forward end thereof and aligned longitudinally centrally thereof. An oval collar 27 is adapted to fit against the front end of the core 21, and has a generally rectangular opening 28 therethrough provided with an enlarged circular counterbore 29 (see FIGS. 2, 4 and 5).

Referring in particular to FIGS. 1–5, the grip sleeve 30 is also substantially oval in transverse cross section and is adapted to be fitted over the rear end of the core 21, the sleeve having an elongated, generally rectangular opening 31 formed in the top thereof and extending along most of the length thereof, and a generally rectangular bottom opening 32 substantially congruent with the top opening 31. The rear portion of the grip sleeve 30 forms a thickened grip portion 33 provided in the outer surface thereof with a plurality of longitudinally spaced finger recesses 34 along each side thereof. The rear end of the grip sleeve 30 is closed by an end cap 35 which is provided with an oblong aperture 36 therethrough, which could be utilized for hanging the torque wrench 20 or could receive a tether cord or the like. When the grip sleeve 30 is fitted over the tubular core 21, the elongated aperture 22 in the core 21 is substantially congruent with the forward portion of the top opening 31 in the grip sleeve 30, while the rectangular aperture 23 in the bottom of the core 21 communicates with the rear portion of the bottom opening 32 of the grip sleeve 30.

Figure 5:
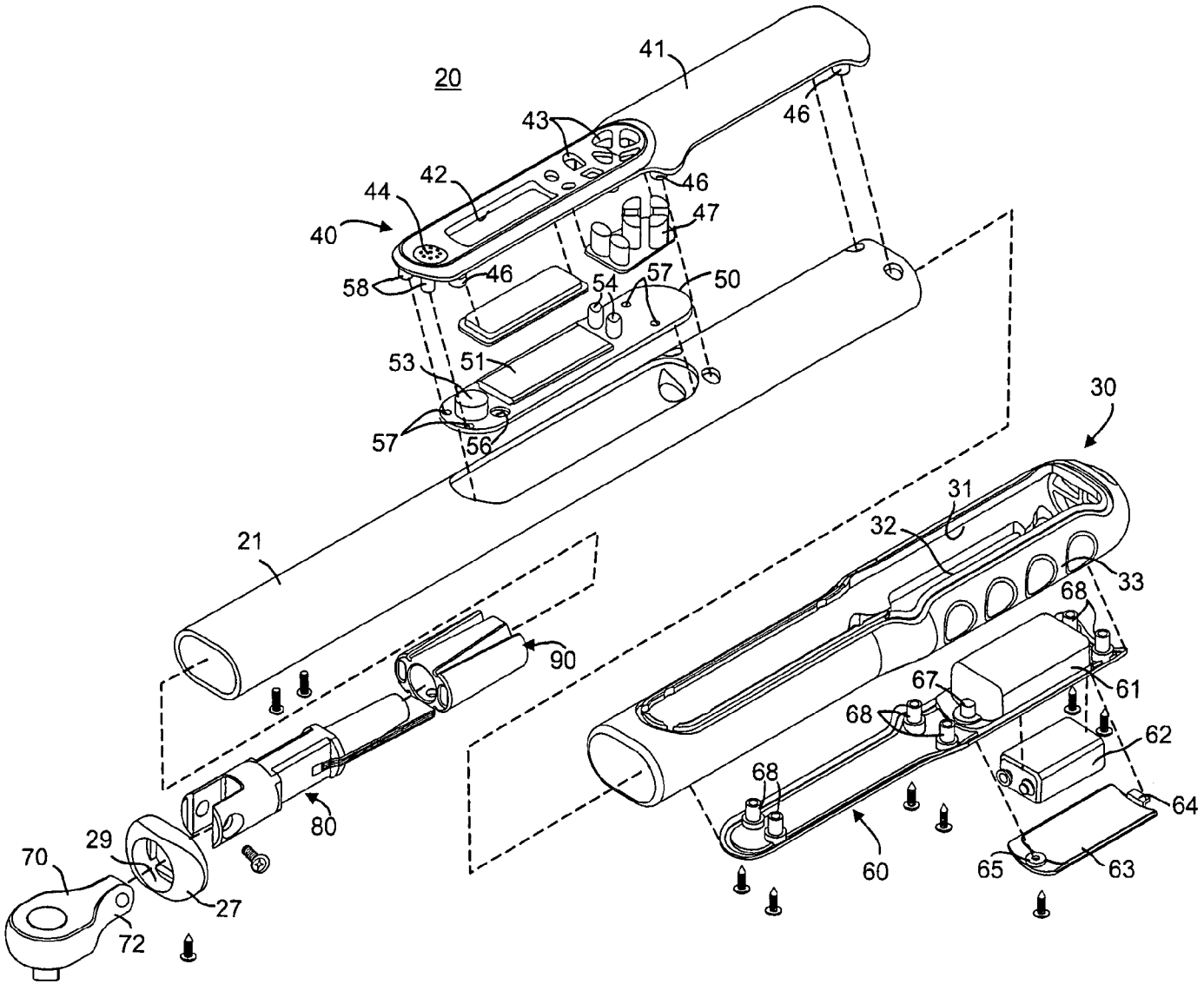
FIG. 5 is a reduced, exploded, perspective view of the torque wrench of FIG. 1.

The torque wrench 20 includes an electronic module which forms a user interface assembly 40. The assembly 40 includes an elongated upper panel 41 shaped and dimensioned to mateably fit over and close the top opening 31 of the grip sleeve 30. Formed through the upper panel 41 adjacent to the forward end thereof is an elongated rectangular aperture 42 (FIG. 5). Also formed through the upper panel 41 are a plurality of key holes 43, a circular array of annunciator holes 44 and a pair of LED holes 45. Depending from the inner surface of the upper panel 41 is a plurality of internally threaded cylindrical bosses 46, the forward ones of which fit downwardly through the forward end of the aperture 22 in the core 21, and the rear four of which respectively fit into the medium-sized holes 25 in the core 21. The interface assembly 40 also includes a keypad 47 including four generally triangular keys 48 and two somewhat oblong keys 49 adapted to respectively fit through the key holes 43 in the upper panel 41.

The keypad 47 is fixedly secured to a printed circuit board (PCB) 50, which carries an LCD display panel 51 provided with an associated lens 52 adapted to fit in the aperture 42 in the upper panel 41. Also mounted on the PCB 50 is an audible annunciator, which may be in the form of a buzzer 53, positioned so as to be disposed immediately beneath the annunciator holes 44 in the upper panel 41. Two LEDs 54 on the PCB 50 are disposed to fit respectively in the LED holes 45 in the upper panel 41. The PCB 50 is provided with holes 56 therethrough for respectively receiving two of the bosses 46 of the upper panel 41. The PCB 50 is also provided with two pairs of small holes 57 therethrough, respectively adjacent to the forward and rearward ends thereof, for respectively receiving suitable fasteners for threaded engagement in bosses 58 depending from the upper panel 41, for fixedly securing the PCB 50 to the upper panel 41 (see FIGS. 2 and 5).

The interface assembly 40 also includes a lower panel 60 which is similar in shape to the upper panel 41 and is disposed for mateably being received in and covering the bottom opening 32 of the grip sleeve 30. The lower panel 60 carries on its inner surface adjacent to the rear end thereof a power assembly, including an open-bottom, box-like battery receptacle 61 adapted to receive a battery 62, such as a 9-volt battery. It will be appreciated that the receptacle 61 is provided with suitable terminals (not shown) for mateably connecting with the terminals of the battery 62 and which are connected by suitable conductors (not shown) to the circuitry on the PCB 50. The open bottom of the receptacle 61 communicates with a rectangular aperture in the rear portion of the lower panel 60, which is covered by a cover 63, having a tab 64 adapted to fit against the inner surface of the lower panel 60 and a hole 65 for receiving a suitable fastener for threaded engagement in an internally-threaded boss 67 on the receptacle 61. Three pairs of tubular bosses 68 communicate with holes through the lower panel 60 and project upwardly therefrom, respectively adjacent to the forward and rearward ends thereof and approximately midway between the ends thereof, respectively fitting through the holes 24 and 25 in the tubular core 21, for respective alignment with the bosses 46 of the upper panel 41. Suitable fasteners (not shown) are received through the bosses 68 and threadedly engaged in the bosses 46 for securing the upper and lower panels 41 and 60 together and to the tubular core 21, the upper and lower panels 41 and 60 cooperating to retain the grip sleeve 30 in place.

Figure 4:
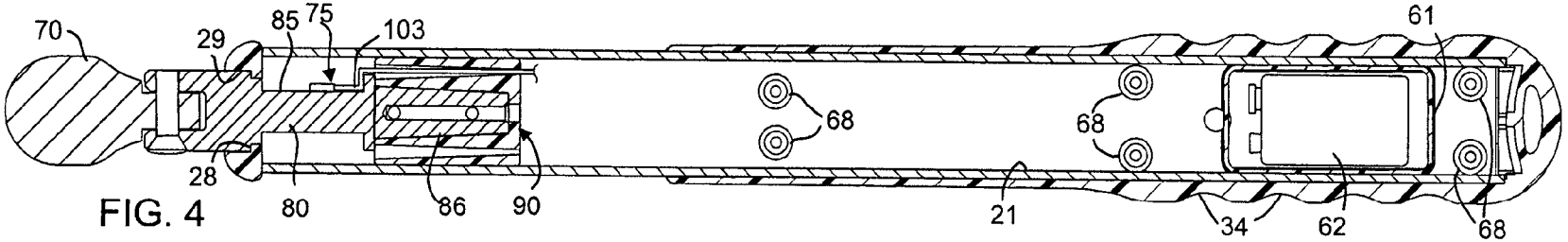
FIG. 4 is a sectional view taken generally along the line 4—4 in FIG. 3.

The torque wrench 20 also includes a head assembly including a head 70 provided with a drive lug 71 which may be square in transverse cross section. Projecting from the head 70 is a neck 72 with a hole therethrough in a known manner. The head 70 is of known construction and may be a ratchet head providing for ratcheting rotation of the drive lug 71 relative to the frame of the head and, in that case, the ratchet mechanism may be reversible and may be provided with a suitable reversing lever, all in a known manner. The head 70 is adapted to be pivotally mounted on a sensor beam assembly 75 (FIG. 4).

Referring now also to FIGS. 10–13, the sensor beam assembly 75 includes an elongated sensor beam 80 provided at its forward end with a cylindrical yoke 81 having a pair of forwardly projecting arms 82 spaced apart for receiving the head neck 72 therebetween. Aligned holes 83 are respectively formed through the arms 82 for alignment with the hole and the head neck 72 to receive a suitable pivot pin for pivotally mounting the head 70 on the yoke 81. The sensor beam 80 is provided intermediate its ends with four flats 84 arranged in a substantially square configuration, two opposed ones of the flats being further recessed to define deep flats 85. The rear end of the sensor beam 80 has a tapered, generally frustoconical portion 86, the forward end of which terminates at a shoulder 87. Formed in the rear end of the tapered end 86 is an axial bore 88, and formed radially therein are two longitudinally spaced, circular tapped holes 89 which communicate with the bore 88.

Referring now also to FIGS. 14–18, the sensor beam assembly 75 also includes a shim 90 in a nature of a block which is substantially oval in transverse cross-sectional shape and is provided with an axial bore 91 longitudinally therethrough, one end of which is provided with a tapered, frustoconical counterbore 92. Longitudinally spaced circular fastener holes 93 are formed in the bottom of the shim 90 and communicate with the counterbore 92. Formed longitudinally through the shim 90, respectively on opposite sides of the counterbore 92, are oval tapered side passages 94, which taper from a relatively wide front end to a relatively narrow rear end. Formed in the upper and lower surfaces of the shim 90 are two pairs of tapered grooves 95, with each pair of grooves being laterally spaced-apart and each groove tapering from a relatively wide rear end to a relatively narrow front end.

In assembly, the tapered end 86 of the sensor beam 80 is mateably receivable in the tapered counterbore 92 of the shim 90, with the forward end of the shim 90 stopping against the sensor beam shoulder 87. The shim 90 is dimensioned to be mateably received in the forward end of the tubular core 21, the passages 94 and grooves 95 affording a limited resilient flexibility so as to permit a snug fit of the shim 90 in the core 21. The parts are arranged so that fasteners 98 (see FIG. 2) may be received through the core openings 26 and the shim holes 93 and to be threadedly engaged in the tapped holes 89 of the sensor beam 80 for fixedly securing the shim 90 to the sensor beam 80 and securing the sensor beam assembly 75 in place in the core 21. Before such assembly, the collar 27 is fitted over the rear end of the sensor beam 80, being stopped against the rear end of the yoke 81 at the forward ends of the flats 84 (see FIGS. 2 and 4), so that when the sensor beam assembly 75 is mounted in place, the collar 27 seats against the forward end of the core 21.

Figure 19:
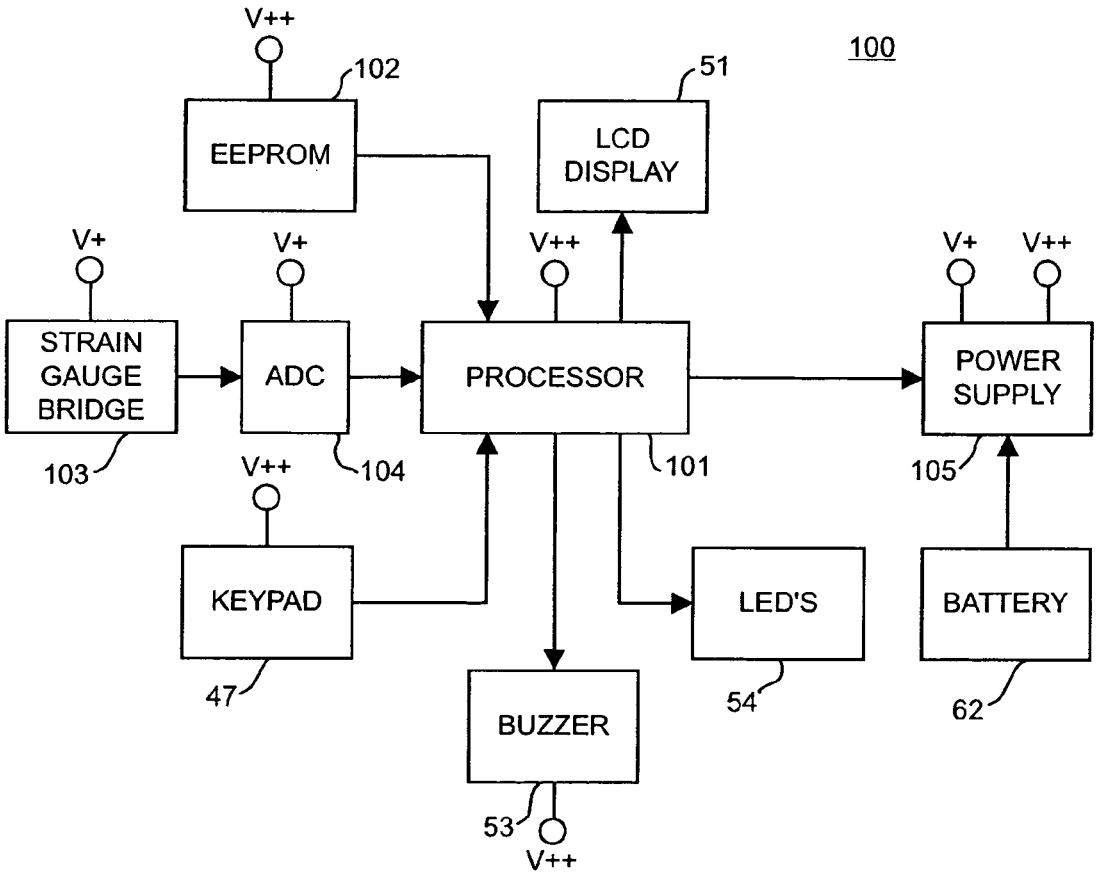
FIG. 19 is a functional block diagrammatic view of the electronic circuitry of the torque wrench of FIG. 1.

Referring now to FIG. 19, the torque measuring apparatus may be more readily understood. FIG. 19 illustrates a functional block diagram of an electronic circuit 100, most of which may be disposed on the PCB 50 for controlling the operation of the torque wrench 10. The circuit 100, as part of the torque measuring apparatus, includes a processor 101, which may be in the nature of a suitable microcontroller, which may have a crystal-controlled clock speed. The processor 101 operates under control of a program, which may be stored within the processor. An EEPROM 102 may be provided to store set up, preset and calibration parameters. A strain gauge bridge 103 may be provided with its output applied to the processor 101 through an analog-to digital converter (ADC) 104. The strain gauge bridge 103 may be physically located on the deep flats 85 of the sensor beam 80 (see FIG. 4) and may be connected to the remainder of the circuitry on the PCB 50 by suitable wires extending through the side passages 94 of the shim 90. The keypad 47 forms a data input device which is coupled to the processor 101. The keypad 47 forms a part of the user interface, which also includes the buzzer 53, the LCD display 51 and the LEDs 54, all of which are also coupled to the processor 101. The battery 62 may be coupled to a suitable power supply 105, which is also coupled to the processor 101. The power supply 105 may include suitable voltage regulators and produce regulated DC supply voltages V+ and V++, which can be provided to the other components of the electronic circuit 100, as needed.

The operation of the torque wrench 20 is similar to that described in the aforementioned copending application Ser. No. 10/293,006, and will not be described in detail here. However, the LCD display 51 may be operated to provide display indications of low battery 110, clockwise/counterclockwise operation 111, percent tolerance, memory, and selected units of measure 112. The user may input a preprogrammed selectable torque value and the wrench may provide visual and audible alerts at preset, tolerance and overload coincidence. The wrench may be operated in combined torque tracking and peak capture display modes. While a six-button keypad 47 is illustrated, it will be appreciated that a four-button arrangement could also be utilized, as is explained in greater detail in the aforementioned copending application.

Figure 20:
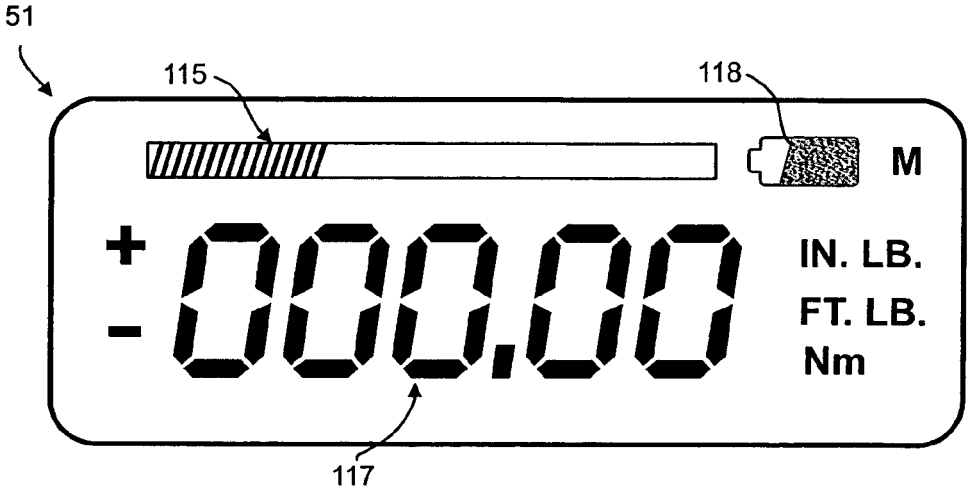
FIG. 20 is a schematic diagram of a type of display which may be used in the torque wrench of FIG. 1.

The display 51 may be operated to provide a bar graphic to give a user an approximation of the approach to or achievement of a predetermined torque setting. Referring to FIG. 20, such a graphic is illustrated at 115, and may be an advancing or ascending graphic with a total window length corresponding to the predetermined torque value, with progressively greater portions of the window being "filled in" or illuminated as the predetermined torque value is approached so that the percentage of the bar illuminated is proportional to the ratio of the measured torque to the preset torque value. An LED or LCD multi-segment display 117 may provide a display of the preset torque value and/or the measured torque value.

The grip portion 33 of the grip sleeve 30 may be formed of a suitable flexible and resilient and frictional gripping material, such as a suitable elastomeric material, to provide a good grip. Also, the oval shape of the torque wrench core 21, together with the design of the grip sleeve 30, provides an improved ergonomic feel. It can be seen that the design permits easy removal or replacement of the interface assembly 40, by simply removing a few screws. While a pivoting head 70 is illustrated, it will be appreciated that the pivot arrangement could also be one of an indexing nature or, alternatively, a fixed head could be provided. The arrangement described affords a very rugged and durable construction, while being relatively easy to assemble.

Figure 5A:
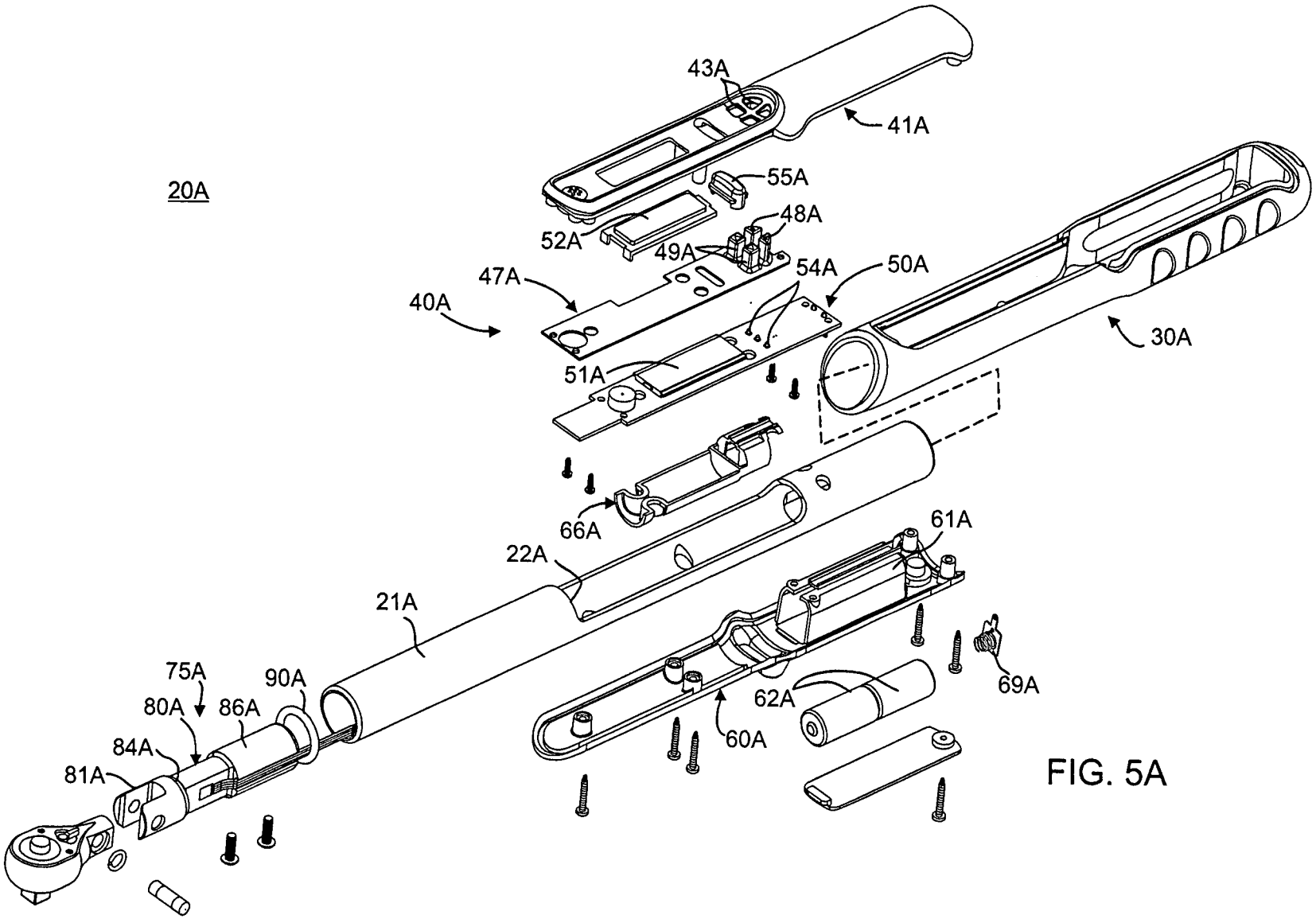
FIG. 5A is a view similar to FIG. 5 of an alternative embodiment of an electronic torque wrench.
Figure 6:
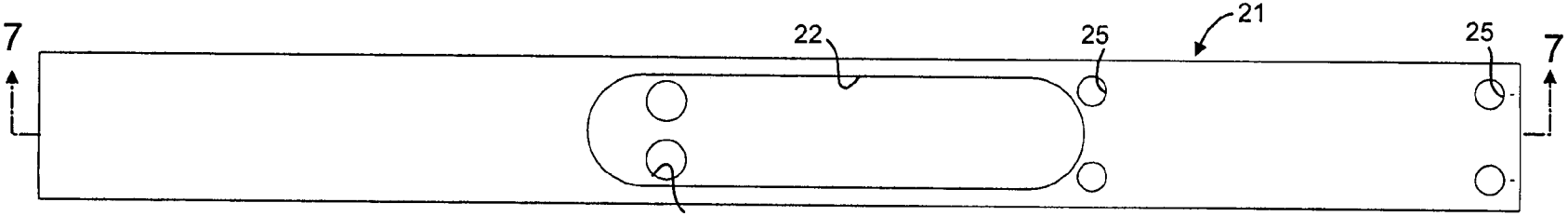
FIG. 6 is a top plan view of the handle core of the torque wrench of FIG. 1.
Figure 7:
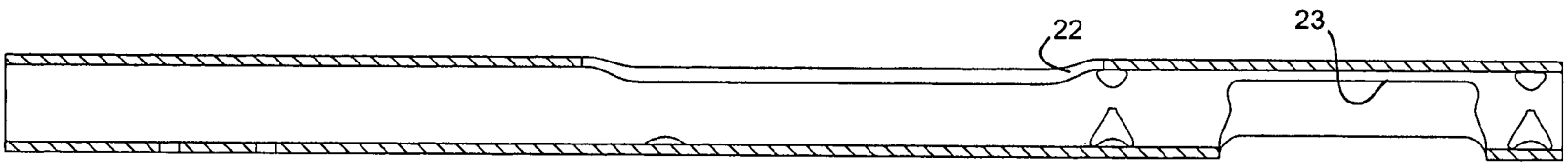
FIG. 7 is a sectional view taken generally along the line 7—7 in FIG. 6.
Figure 8:
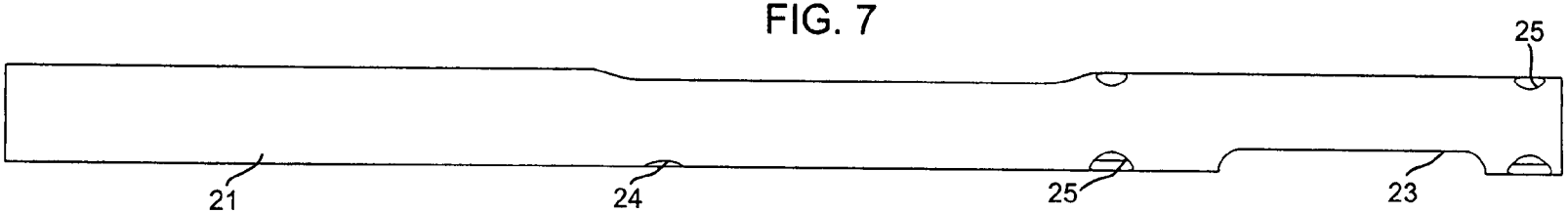
FIG. 8 is a front elevational view of the handle core of FIG. 6.
Figure 9:
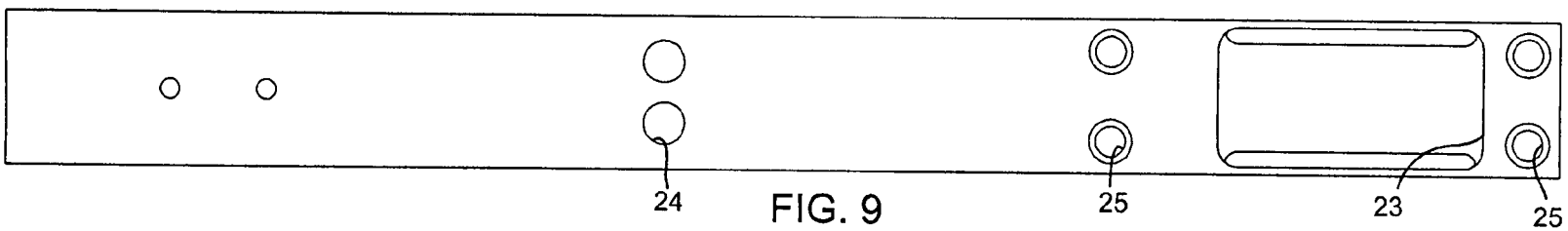
FIG. 9 is a bottom plan view of the handle core of FIG. 6.
Figure 11:
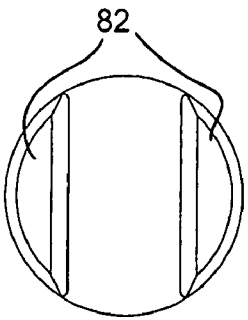
FIG. 11 is a left end elevational view of the sensor beam of FIG. 10.
Figure 10:
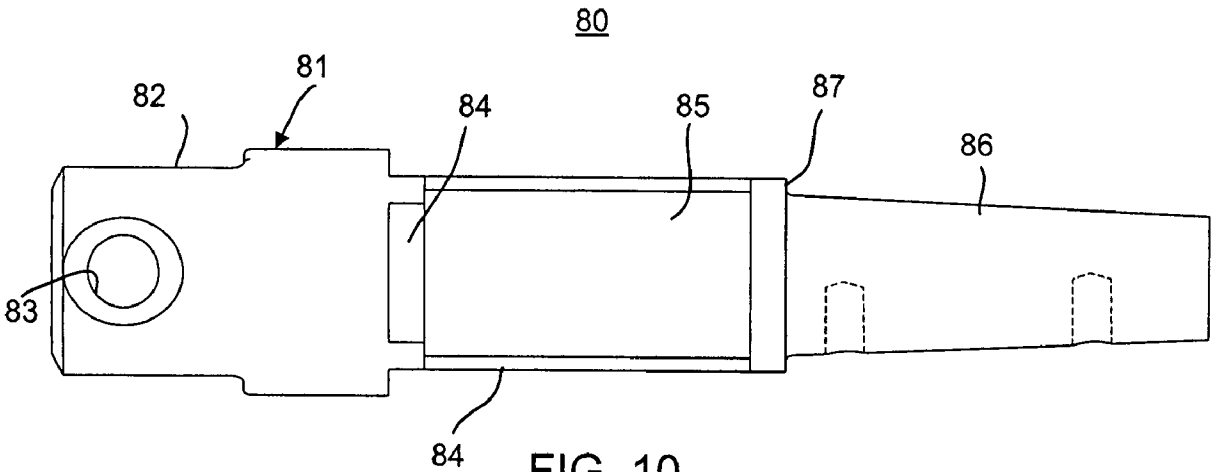
FIG. 10 is an enlarged side elevational view of the sensor beam of the torque wrench of FIG. 1.
Figure 13:
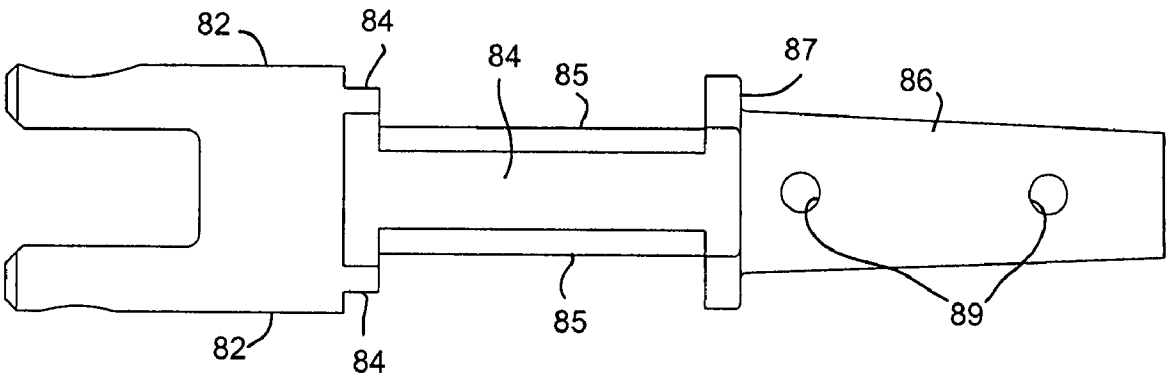
FIG. 13 is a bottom plan view of the sensor beam of FIG. 10, rotated 90° clockwise.
Figure 12:
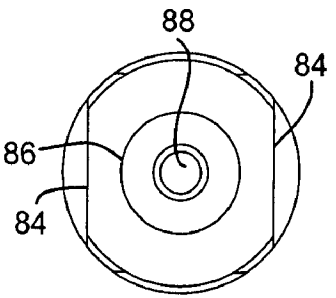
FIG. 12 is a right end elevational view of the sensor beam of FIG. 10.
Figure 14:
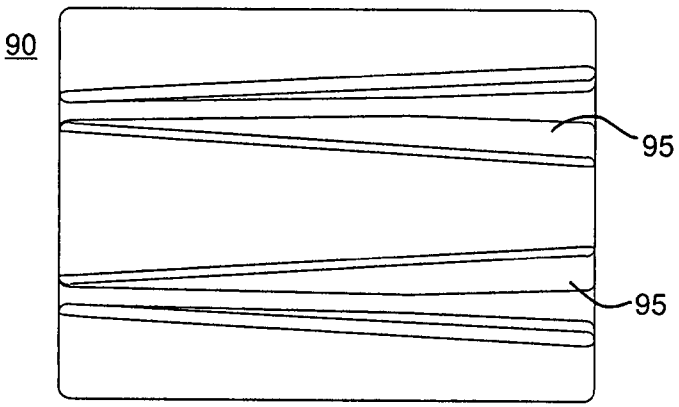
FIG. 14 is an enlarged top plan view of the sensor beam shim for the torque wrench of FIG. 1.
Figure 15:
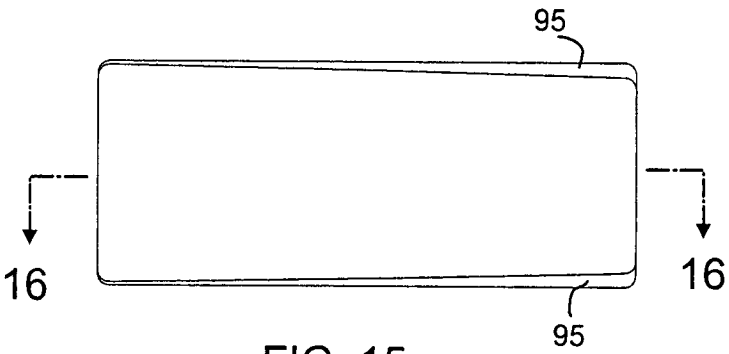
FIG. 15 is a right side elevational view of the shim of FIG. 14, rotated 90° clockwise.
Figure 16:
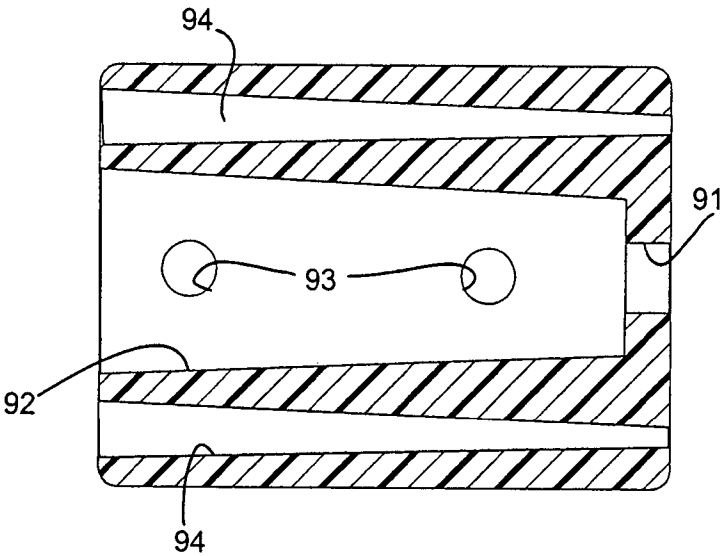
FIG. 16 is a sectional view taken along the line 16—16 in FIG. 15.
Figure 17:
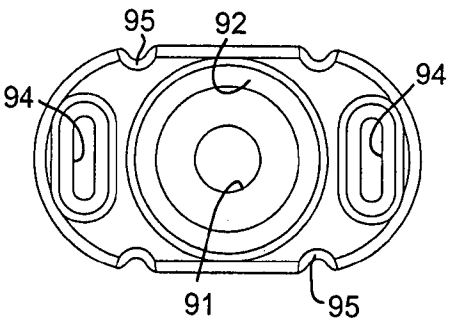
FIG. 17 is a left end elevational view of the shim of FIG. 15.
Figure 18:
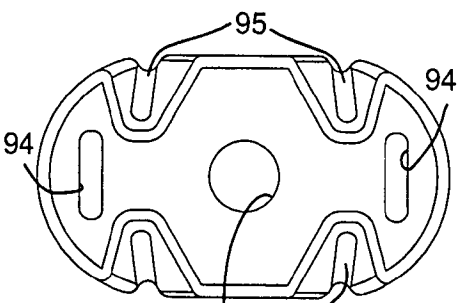
FIG. 18 is a right end elevational view of the shim of FIG. 15.

Referring to FIG. 5A, there is illustrated an alternative embodiment of torque wrench, generally designated by the numeral 20A, which is substantially similar to the torque wrench 20, described above. Parts of the wrench 20A which correspond to parts of the wrench 20 have the same reference numerals with the suffix "A", and only so much of the wrench 20A will be described herein as is necessary to explain the significant differences from the wrench 20.

The wrench 20A has a handle core 21A which is substantially circular in transverse cross-sectional shape and has a rectangular aperture 22A therein which is substantially longer and deeper than the corresponding aperture in the wrench 20. The collar 27 of the wrench 20 is omitted in the wrench 20A. The wrench 20A has a grip sleeve 30A, the forward end of which is circular in transverse cross section. The wrench 20A has a user interface assembly 40A which includes a keypad board 47A having a pair of generally triangular keys 48A and a pair of substantially square keys 49A adapted to respectively fit through keyholes 43A in an upper panel 41A. The keypad board 47A overlies a printed circuit board 50A which carries an LCD display panel 51A provided with an associated lens 52A, the panel 51A being raised sufficiently to allow the board 47A to fit therebeneath. Three LED's 54A are disposed to fit through an oblong aperture in the keypad board 47A and may be covered with a suitable lens 55A.

The interface assembly 40A also includes a lower panel 60A which has a pair of spaced angle brackets 61A which cooperate to form a receptacle adapted to receive a pair of batteries 62A, such as Lithium batteries, the forward end of which may be received in the rear end of a cradle member 66A and may be urged against suitable contacts (not shown) by a spring member 69A. A finger (not shown) on the upper panel 41A engages the forward end of the cradle 66A to limit forward movement of the cradle and the batteries.

A sensor beam assembly 75A includes an elongated sensor beam 80A with a yoke 81A at its forward end separated by an annular shoulder 84A from the flats of the sensor beam. The sensor beam 80A has a cylindrical rear end 86A adapted to be telescopically fit within the forward end of the handle core 21A, with the shoulder 84A seated against an O-ring 90A which, in turn, seats against the forward end of the core 21A. The sensor beam 80A is held in place by suitable screws. Thus, the shim 90 of the wrench 20 is omitted.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants' contribution.

What is claimed is:

1. An electronic torque wrench comprising:

a housing assembly including an inner generally tubular core having first and second elongated apertures formed therein, a grip sleeve telescopically received over the core and having first and second openings therein respectively communicating with the first and second apertures, a user interface assembly coupled to the core and also coupled to a torque measuring apparatus, said user interface assembly disposed in the first aperture and the first opening, and a power assembly coupled to the core and disposed in the second aperture and the second opening and electrically connected to the user interface assembly;

a workpiece-engaging head carried by the core; and sensing apparatus carried by the housing assembly and connected to the torque measuring apparatus.

2. The wrench of claim 1, wherein the user interface assembly includes a panel disposed in and closing the first aperture and the first opening, the power assembly including a panel disposed and enclosing the second aperture and the second opening.

3. The wrench of claim 2, wherein the first and second openings are respectively substantially longer than the first and second apertures.

4. The wrench of claim 3, and further comprising fasteners fixedly securing the panels to the tubular core.

5. The wrench of claim 1, wherein the user interface assembly includes a display and a keypad.

6. The wrench of claim 1, wherein the tubular core is oval in transverse cross section.

7. The wrench of claim 1, wherein the tubular core is circular in transverse cross section.

8. The wrench of claim 1, wherein the sensing apparatus includes a beam member coupled between the head and the tubular core, and a strain gauge assembly carried by the beam member.

* * * * *